US006543075B2

(12) United States Patent
Gultekin et al.

(10) Patent No.: US 6,543,075 B2
(45) Date of Patent: Apr. 8, 2003

(54) SHOE COVER APPLICATOR DEVICE

(75) Inventors: Goktan Gultekin, Otagtepe Cad. No. 33 Onur Sitesi A-5, Anadolu Hisari-Istanbul (TR); Gurkan Gultekin, Istanbul (TR); Barbaros Soylerkaya, Beylerbeyi-Istanbul (TR)

(73) Assignee: Goktan Gultekin, Istanbul (TR)

( * ) Notice: Subject to any disclaimer, the term of this patent is extended or adjusted under 35 U.S.C. 154(b) by 0 days.

(21) Appl. No.: 09/901,148

(22) Filed: Jul. 10, 2001

(65) Prior Publication Data

US 2002/0020031 A1 Feb. 21, 2002

(30) Foreign Application Priority Data

Jul. 11, 2000 (TR) ..... 2000/02031

(51) Int. Cl.[7] ..... A43D 11/00
(52) U.S. Cl. ..... 12/1 R; 12/142 R; 36/72 R
(58) Field of Search ..... 12/1 R, 142 R; 36/72 R

(56) References Cited

U.S. PATENT DOCUMENTS

| | | | |
|---|---|---|---|
| 3,337,770 | A | 8/1967 | Saraceni et al. |
| 3,402,323 | A | 9/1968 | Longstreth |
| 3,419,929 | A | 1/1969 | Snow et al. |
| 3,525,110 | A | 8/1970 | Batchelder et al. |
| 3,634,954 | A | 1/1972 | Larsen et al. |
| 3,694,939 | A | 10/1972 | Chen |
| 3,775,793 | A | 12/1973 | Casavant et al. |
| 3,898,750 | A | 8/1975 | Epstein |
| 4,019,265 | A | 4/1977 | Epstein |
| 4,083,124 | A | 4/1978 | Michalak |
| 4,272,859 | A | 6/1981 | Vanhove |
| 4,304,021 | A | 12/1981 | Theodorsen |
| 4,335,527 | A | 6/1982 | Pask |
| 4,598,485 | A | 7/1986 | Joe et al. |
| 4,610,042 | A | 9/1986 | Theodorsen |
| 4,616,428 | A | 10/1986 | Leger |
| 4,616,429 | A | 10/1986 | Alcala |
| 4,847,934 | A | 7/1989 | Weber |
| 4,850,122 | A | 7/1989 | Schwab, Jr. |
| 4,918,839 | A | 4/1990 | Brandon |
| 4,937,881 | A | 7/1990 | Heise |
| 5,059,277 | A | 10/1991 | Willhite, Jr. et al. |
| 5,062,223 | A | 11/1991 | Johnson |
| 5,165,182 | A | 11/1992 | Michael |
| 5,228,215 | A | 7/1993 | Bayer |
| 5,763,337 | A | 6/1998 | Montgomery |
| 5,776,295 | A | 7/1998 | Montgomery |
| 5,787,607 | A | 8/1998 | Schurch |
| 5,842,290 | A | 12/1998 | Mills |
| 5,845,416 | A | 12/1998 | Hands |
| 5,867,825 | A | 2/1999 | Scheerer |
| 5,890,302 | A | 4/1999 | Kirkis |
| 5,983,526 | A | 11/1999 | Pawlik et al. |
| 5,996,258 | A | 12/1999 | Simmons |
| 6,023,856 | A | 2/2000 | Brunson et al. |
| 6,067,731 | A | 5/2000 | Chen et al. |
| 6,117,515 | A | 9/2000 | Brunson et al. |
| 6,209,227 | B1 | 4/2001 | Swango et al. |
| 6,219,938 | B1 | 4/2001 | Anderson |

FOREIGN PATENT DOCUMENTS

| | | |
|---|---|---|
| FR | 2 610 568 | 10/1987 |
| WO | 99/55183 | 4/1999 |

*Primary Examiner*—M. D. Patterson
(74) *Attorney, Agent, or Firm*—Howrey Simon Arnold & White, LLP; Michael J. Bell

(57) ABSTRACT

A shoe cover application device having a holding member for holding a shoe cover open in a receiving position to accommodate the insertion of a user shoe. The shoe cover application device also includes a separation member that separates the shoe cover from the holding member allowing the shoe cover to constrict around the user's shoe inserted into the shoe cover while the shoe cover was in the receiving position. Shoe covers of various materials, shapes and sizes may be used with the shoe cover application device of the present invention.

15 Claims, 10 Drawing Sheets

SHOE COVER APPLICATOR DEVICE

BACKGROUND OF THE INVENTION

Protective disposable garments such as gowns, drapes, caps and shoe covers have been used for many years to minimize contamination in "cleanrooms" such as laboratories and medical operating rooms. Disposable shoe covers, in particular, are of great importance in these environments, as shoes are in constant contact with the "clean" area. In settings such as these, the shoe covers serve to protect the sterile atmosphere from dust and any other contaminates human traffic may introduce.

Shoe covers also serve to protect the wearer from hazards already present in these environments. The shoe covers prevent the wearer from being exposed to hazards such as electricity, chemicals, metals, microbiological agents, disease and tools. It is thus desirable to design a disposable shoe cover that prevents the transmission of contaminates to and from a shoe.

The use of disposable shoe covers is not limited to the aforementioned environments. Each environment requires a shoe cover made of a material having specific characteristics. As a result, disposable shoe covers may need to be fabricated from a wide array of materials including polyethylene or polypropylene sheet materials, non-woven fabrics or other disposable materials. It is therefore also desirable to design a disposable shoe cover that can be manufactured out of varied materials. Furthermore, the assortment of shoe shapes and sizes necessitate disposable shoe covers of various shapes and sizes.

Finally, it is necessary to design a disposable shoe cover that can be applied onto the wearer's shoe without the handling of the disposable shoe cover itself. If not, the purpose of maintaining a sterile preparation routine before entering to the clean room area may be defeated. Manual handling of the shoe covers may spoil the sanitary nature of the shoe covers. Most disposable shoe covers available today require manual application.

Nonetheless, attempts to address this concern have been made. An example of an automated shoe cover application device is disclosed in U.S. Pat. No. 3,694,939 which discloses an operation wherein the wearer's shoe is wrapped in heat-shrinkable material upon the insertion of the wearer's foot into a shrink-wrap device. While this type of device may do away with the need to manually handle the shoe cover during is application upon a shoe, it is not adaptable to be used with a wide range of disposable shoe covers made of the varying materials needed for various types of sanitary environments.

Additionally, such a device is expensive, complicated and could be dangerous. A heat-shrinking operation, such as the one disclosed in the aforementioned patent, requires multiple motors, a heating unit, heating elements, a blower and extensive wiring and electrical controllers. These elements are not only expensive but also form an intricate system that is difficult to maintain and repair. Furthermore, such an extensive electrical heating system increases the risk of injury to the user who must set his or her foot into the device to have it shrink-wrapped.

As described above, many approaches for applying shoe covers to a wearer's shoe have been proposes. Yet, there remains a need for a simple, inexpensive and safe means for applying shoe covers to a wearer's shoe without the handling of the shoe cover itself. Further, there is a need for an automatic shoe cover applicator compatible with shoe covers of varied materials, shapes and sizes.

SUMMARY OF THE INVENTION

Additional features and advantages of the invention will be set forth in the description which follow, an in part will be apparent from the description, or may be learned by practice of the invention. The objectives and other advantages of the invention will be realized and attained by the apparatus particularly pointed out in the written description and claims hereof as well as the appended drawings.

To achieve these and other advantages and in accordance with the purpose of the invention, as embodies and broadly described, the invention consists of shoe cover application device having a holding arrangement to hold a shoe cover open in a receiving position for the insertion of a user's shoe. There is also a separation member operable to separate the shoe cover from the holding arrangement allowing the shoe cover to constrict around the user's shoe that was inserted into the shoe cover while the shoe cover was in the receiving position.

An embodiment of the present invention also includes a guiding system utilized to guide the shoe covers from a storage bin to the holding arrangement, a retaining member responsible, while in a retaining position, for preventing the guiding of the shoe covers from the storage bin to the holding arrangement, and an actuator to both initiate the operation of the separation member and control the position of the retaining member.

It is an object of the present invention to provide a shoe cover application device that applies a shoe cover to a user's shoe with the manual handing of the shoe cover itself.

It is another object of the present invention to provide an automatic shoe cover application device that is simple, inexpensive and safe to use.

It is yet another object of the present invention to provide an automatic shoe cover application device compatible with shoe covers of varied materials, shapes and sizes.

These and other objects of the present invention will become readily apparent upon further review of the following specification and drawings. It is understood that both the foregoing general description and the following detailed description are exemplary and explanatory and are intended to provide further explanation of the invention as claimed. The accompanying drawings are included to provide a further understanding of the invention and are incorporated in and constitute a part of this specification, illustrate several embodiments of the invention and, together with the description, serve to explain the principles of the invention.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
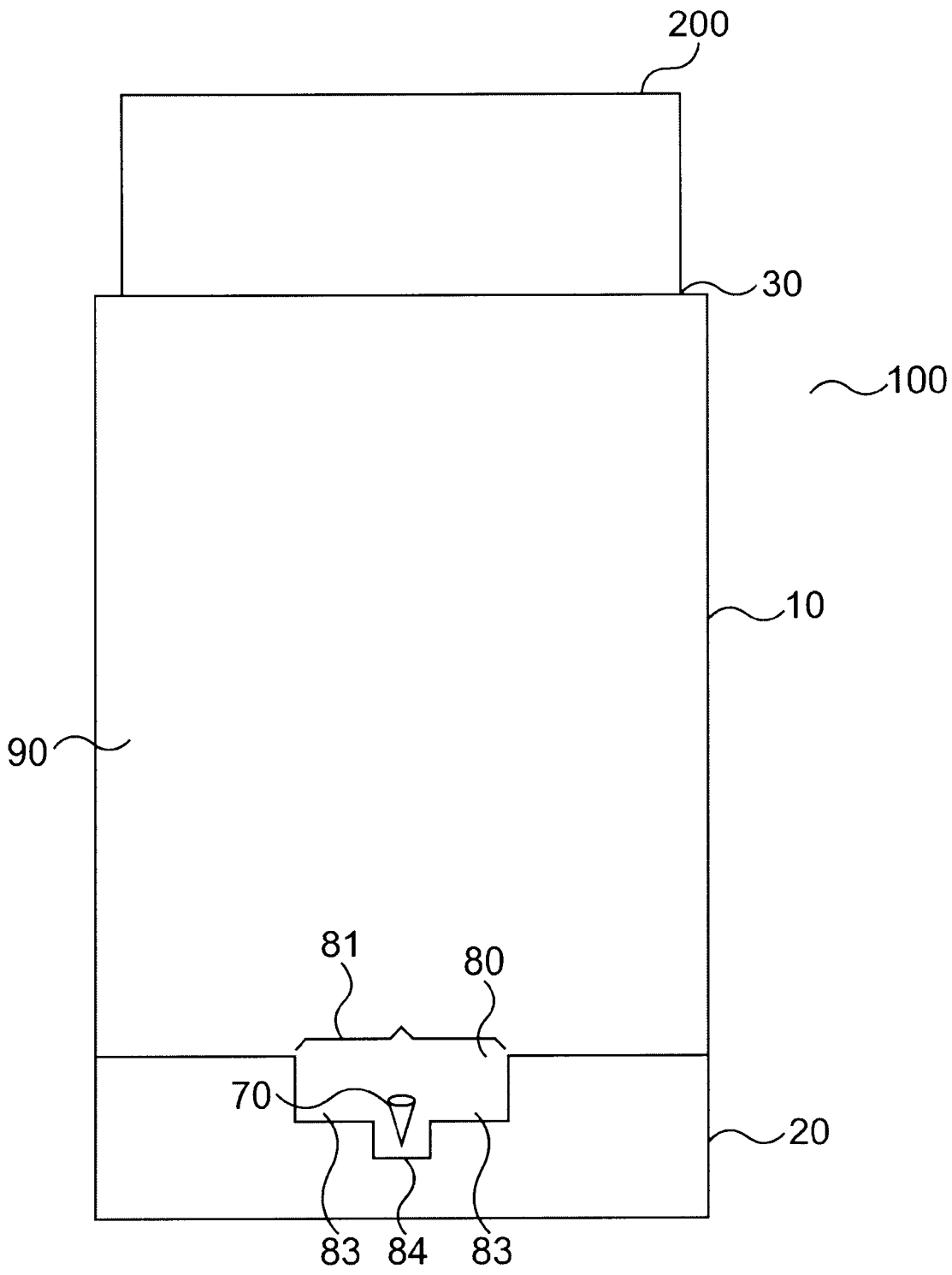
FIG. 1 is a front view of a first embodiment of a shoe cover application device according to the present invention.

FIGS. 1–8 show the preferred embodiment of a shoe cover applicator device 100. As shown specifically in FIG. 1, the shoe cover applicator device 100 has a body 10, base 20, and bin 30. The bin 30 is configured to receive a package 200 of shoe covers. In one embodiment, the package 200 consists of continuous disposable shoe covers in a sealed package, as described in U.S. patent application Ser. No. 09/901,139, filed herewith. An example of the continuous type disposable shoe cover 310 is shown in FIG. 10.

Figure 10:
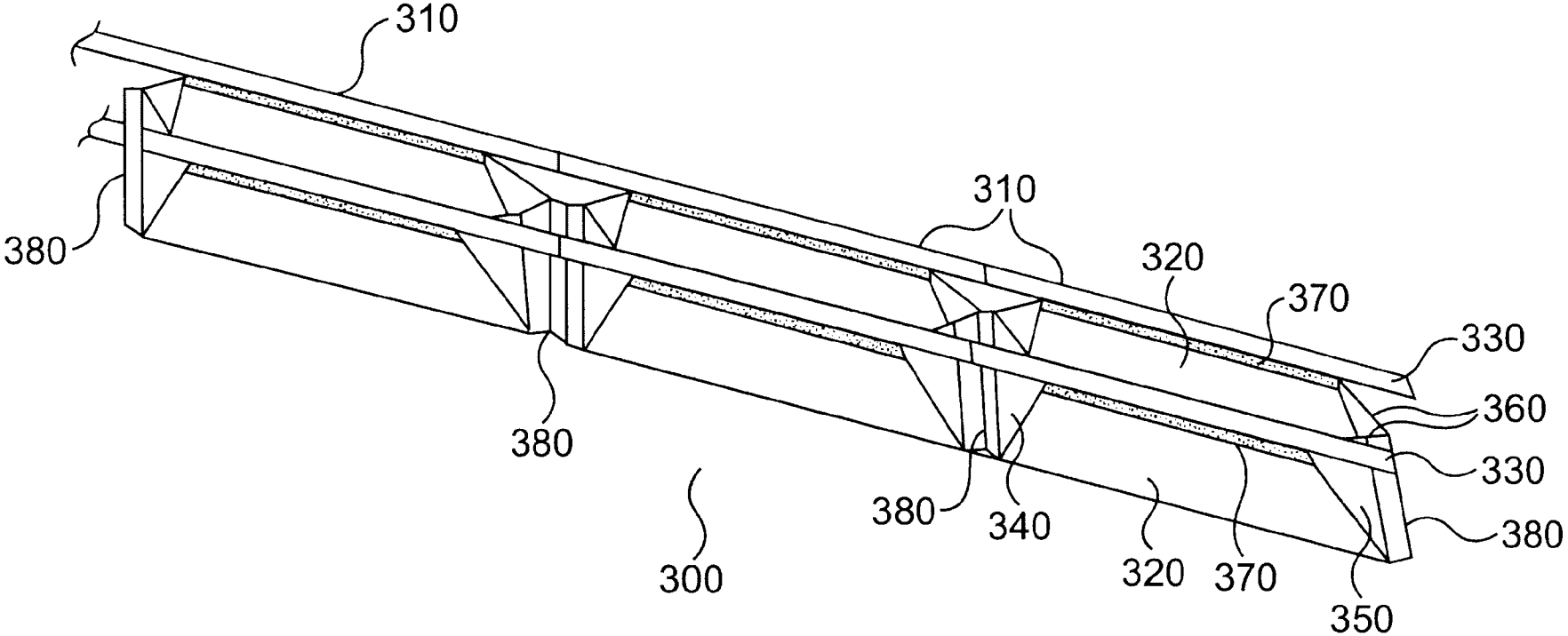
FIG. 10 is a perspective view of a continuous type shoe cover lineal used with the device according to FIG. 1.

The continuous type disposable shoe cover 310 of the preferred embodiment as shown in FIG. 10 will now be described in detail. As seen in the figure, multiple continuous type disposable shoe covers 310 are joined in a lineal 300 of shoe covers 310. Each shoe cover 310 may be separated from the adjoining shoe covers 310 using perforated edges 380. Each individual shoe cover 310 comprises a pair of side walls 320, a heel portion 340 and a toe portion 350. Together the side walls 320, the heel portion 340, and the toe portion 350 define an opening for receiving a shoe.

The shoe covers 310 include tubes 330 formed along the longitudinal edges of the shoe covers 310. The tubes 330 are separated from the side walls 320 along cut lines 360 to form the heel portion 340 and toe portion 350. The tubes 330 allow the shoe cover 310 to be conveyed through device 100. The shoe covers 310 are also provided with at least one elastic member 370 disposed below the tubes 330 and between the heel portion 340 and toe portion 350. The elastic member 370 permits the shoe cover 310 to contract around a shoe inserted into the shoe cover 310 and thereby substantially surround the shoe. It should be understood to one skilled in the art that multiple elastic member 370 or other means known in the art may be used to contract the shoe cover 310 about a shoe.

Generally, during operation, the shoe covers 310 are delivered from the package 200, through the device 100, to an application portion 80. In the application portion 80, the shoe cover 310 is positioned to accommodate entry of the user's foot. The user inserts his or her foot into the opened shoe cover 310 and then pulls his or her foot away from the device 100. As the user's foot is pulled away from the device 100, the shoe cover 310 is separated from the device 100 and another shoe cover 310 is delivered to the application portion 80 awaiting the next user. The operation of the device 100 will be described in more detail below.

Figure 2:
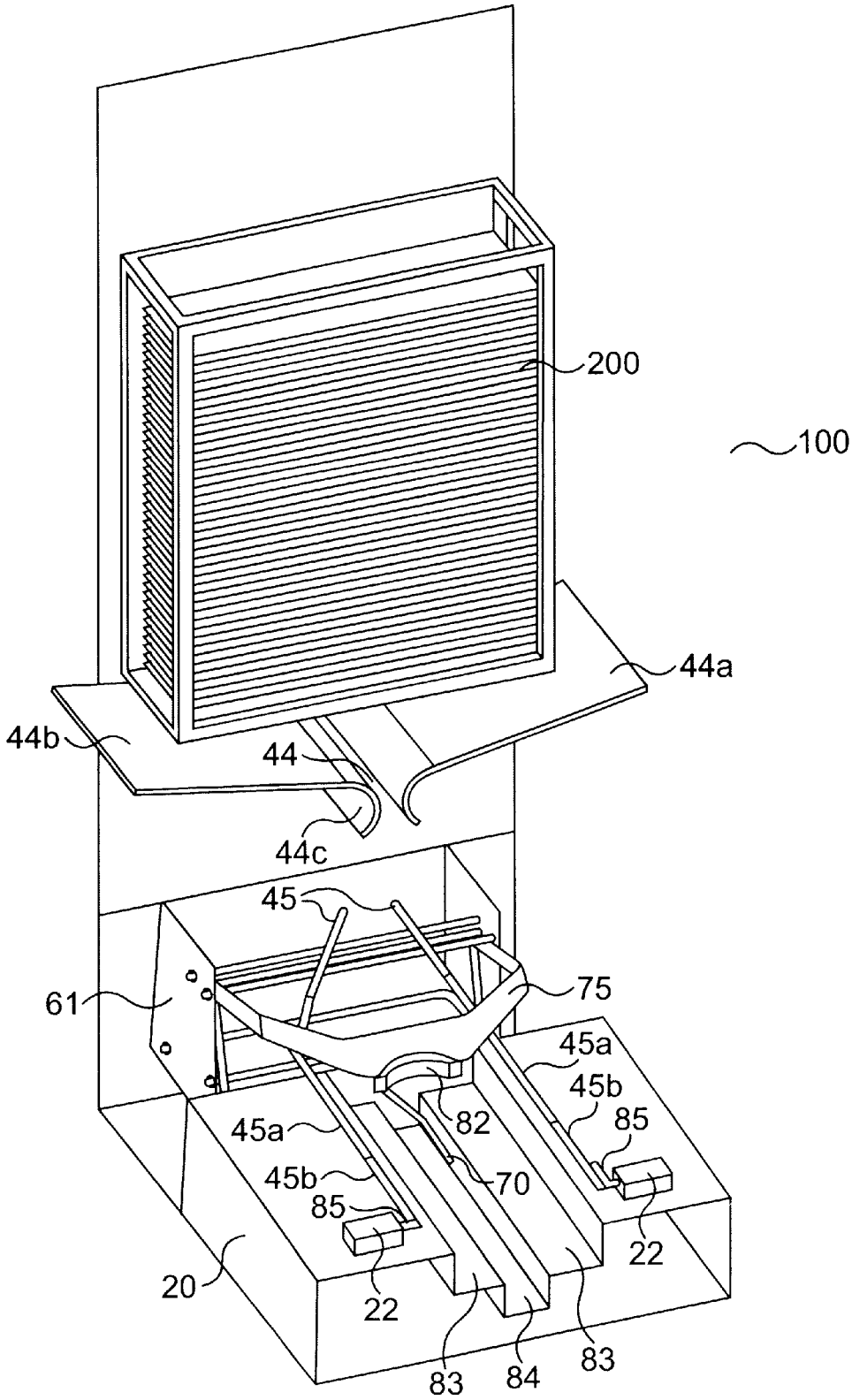
FIG. 2 is a perspective view of a portion of the device according to FIG. 1.

Turning now specifically to FIG. 2. FIG. 2 shows the communication between the package 200 of shoe covers 310 and the device 100. Specifically, the package 200 has an opening (not shown) that may be aligned with an opening (not shown) in bin 30. The shoe covers 310 are manually or automatically fed from package 200 to the device 100 through the openings in the package and bin 30 respectively. Automatic feed of the shoe covers 310 may be triggered by sensing the entry of the foot into the device 100 or the user's actuation of a button, lever, trigger or other means known in the art.

FIG. 2 also illustrates the guiding system 40 of the preferred embodiment. The guiding system 40 functions to guide the shoe cover 310 through the device 100 and deliver the shoe covers 310 to the application portion 80.

In the preferred embodiment, the guiding system 40 includes a funnel 44 and guide members 45. The funnel 44 comprises a pair of sloped arms 44*a* and 44*b* and neck 44*c*. The shoe covers 310 are drawn from package 200, through the funnel 44 and neck 44*c*, and onto the guide members 45. The sloped arms 44*a* and 44*b* of the funnel 44 are mounted on the interior of body 10. One or both of the arms 44*a* and 44*b* may be biased so as slightly "give" as the shoe covers 310 are drawn though device 100 to prevent tearing or separation of the shoe covers 310. The "give" may be provided by a spring 47 or other means known in the art.

Preferably, arm 44*a* is pivotally mounted on body 10 using a hinge (not shown) or the like. The spring provides the bias to arm 44*a*. The hinge is set to limit the movement of arm 44*a* in the upward direction. The spring biases arm 44*a* upwards against the natural tendency of arm 44*a* to rotate downward about the hinge.

Although arm 44*a* is shown in FIG. 2 as being pivotally mounted on body 10, it is to be understood that funnel 44 merely needs to yield sufficiently to prevent the tearing or separation of the shoe covers 310. For instance, it is not necessary that only one of arms 44*a* and 44*b* may be mounted on body 10 in the fashion described above. Both arms 44*a* and 44*b* may be spring mounted on body 10. Moreover, either of arms 44*a* and 44*b* could be manufactured of naturally resilient material providing the "give" required of funnel 44 and not requiring the spring and hinge-mount arrangement of the preferred embodiment.

Figure 3:
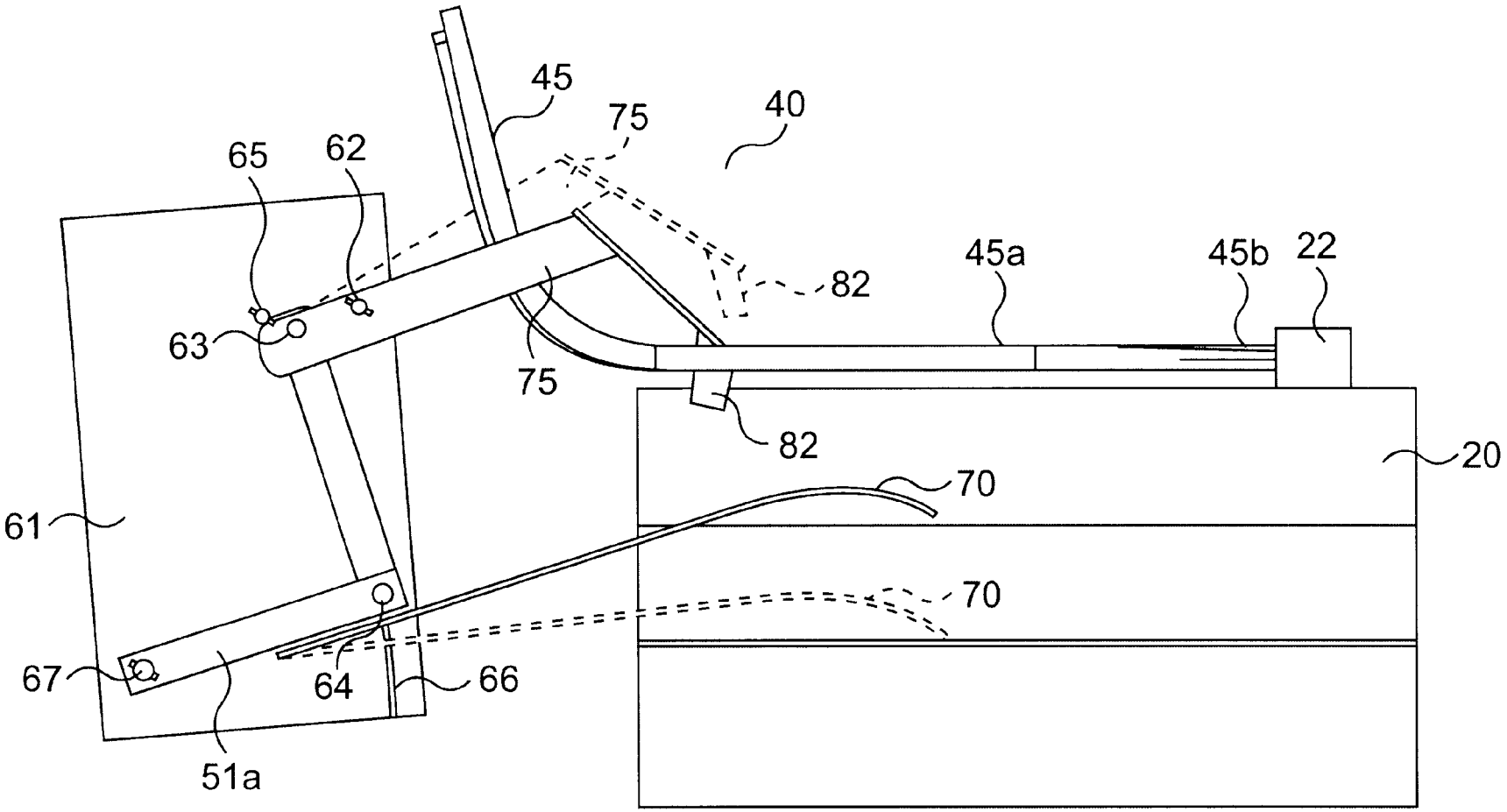
FIG. 3 is an exploded side view of a portion of the device according to FIG. 1.

From the funnel 44, the shoe covers 310 are fed, again either manually or automatically, to guide members 45. As shown in FIG. 3, the guide members 45 extend through body 10 to application portion 80. The guide members 45 are shaped, contoured and spaced apart to not only complete the conveyance of the shoe covers 310 to the application portion 80 but to also hold the shoe cover 310 at least substantially open in the application portion 80 facilitating the insertion of a user's foot into the shoe cover 310. The guide members 45 also preferably include mounting portions 45*b* to mount the guide members 45 to the base 20 using mounting members 22 as shown in FIG. 2.

In the preferred embodiment of the present invention, the device 100 employs the continuous type disposable shoe cover 310 shown in FIG. 10. Accordingly, each guide member 45 is designed to fit into each tube 330 of shoe cover 310. It is important that the tubes 330 of the shoe covers 310 slide along guide members 45 with minimal resistance to avoid the tearing or separation of the shoe covers 310. Thus, although any elongated shape may be suitable for guide members 45, it is preferred that the guide members 45 be shafts having cylindrical cross-sections. Additionally, it is preferable that the guide members 45 are made of low-friction materials, such as teflon, or coated with such a material to minimize the risk of tearing or separating the shoe covers 310.

As mentioned above, the guide members 45 are spaced apart, at least in the application portion 80 of device 100, to hold open the shoe covers 310 so that the user may insert his or her foot into the shoe cover 310. In particular, the ends, or holding portions, 45*a* of the guide members 45 are spaced to hold open the shoe covers 310 within the application portion 80 of the device 100.

In the preferred embodiment using the shoe cover 310 of FIG. 10, the spacing of the holding portions 45*a* is sufficient to pull the tube 330 of the shoe cover 310 apart. Yet, since the tubes 330 are separated from the body of the shoe cover 310 along the cut lines 360, the heel portion 340 and toe portion 350 of the shoe covers 310 are not forced apart by the holding portions 45*a*. The spacing of the holding portions 45*a* pulls apart only the opposing tubes 330 and opposing side walls 320 of the shoe cover 310, providing the user with an adequate opening in which to insert his foot.

Although the preferred arrangement of the guiding system 40 is described above, it is to be understood by one of ordinary skill in the art that a more intricate or simpler guiding system 40 could be incorporated into the shoe cover 310 applicator device 100. For instance, the shoe covers 310 could be drawn out of package 200 and delivered to application portion 80 via vacuum power or other mechanically or electrically powered conveying means. Additionally, the funnel guide 44 may be eliminated altogether. And, other suitable conveying means known in the art could be incorporated into the shoe application device in lieu of the guide members 45. By way of example, as an alternative to guide members 45, a clamping device could hold the shoe cover 310 in place as it is conveyed through device 100.

As described above, through the guiding system 40 of the preferred embodiment, the shoe covers 310 are delivered from package 200 to application portion 80. At application portion 80, the shoe covers 310 are ready to accommodate the insertion of the user's foot. After the user inserts his or her foot into the shoe cover 310, the shoe cover 310 is separated or released from the device 100 so that the user may remove the shoe with the shoe cover 310 on. Following the separation or release of the shoe cover 310, the process starts over (i.e. a new receiving shoe cover 310 is delivered to a receiving position at application portion 80). This new receiving shoe cover 310 is now ready for the next user to insert his or her foot therein.

To carry out the aforementioned separation, release and delivery operations, the device 100 preferably includes a separation member 85 and a retaining member 75 along with an actuator 70 for actuating each. It is to be understood by one skilled in the art, however, that a single component within the device 100 could replace the separation member 85 and the retaining member 75 to perform their respective functions. Nonetheless, in the preferred embodiment, the retaining member 75 cooperates with the guiding system 40 to selectively restrict or permit the advance of the shoe covers 310 throughout the device 100 and delivery of the shoe covers 310 to application portion 80. The separation member 85 acts to separate the shoe cover 310 from the device once the shoe cover 310 is on the user's foot.

More specifically with respect to the preferred embodiment, the user may activate an actuator 70, which in turn triggers the release of a retaining member 75 and activates the separation member 85. The release of retaining member 75 permits the transport of the shoe cover 310 through the device 100. In the same way, the release or deactivation of actuator 70 returns retaining member 75 to an active state and deactivates the separation member 85. While in their active states, retaining member 75 inhibits the movement of the shoe covers 310 through device 100 and separation member 85 separates the shoe cover 310 from device 100.

Figure 4:
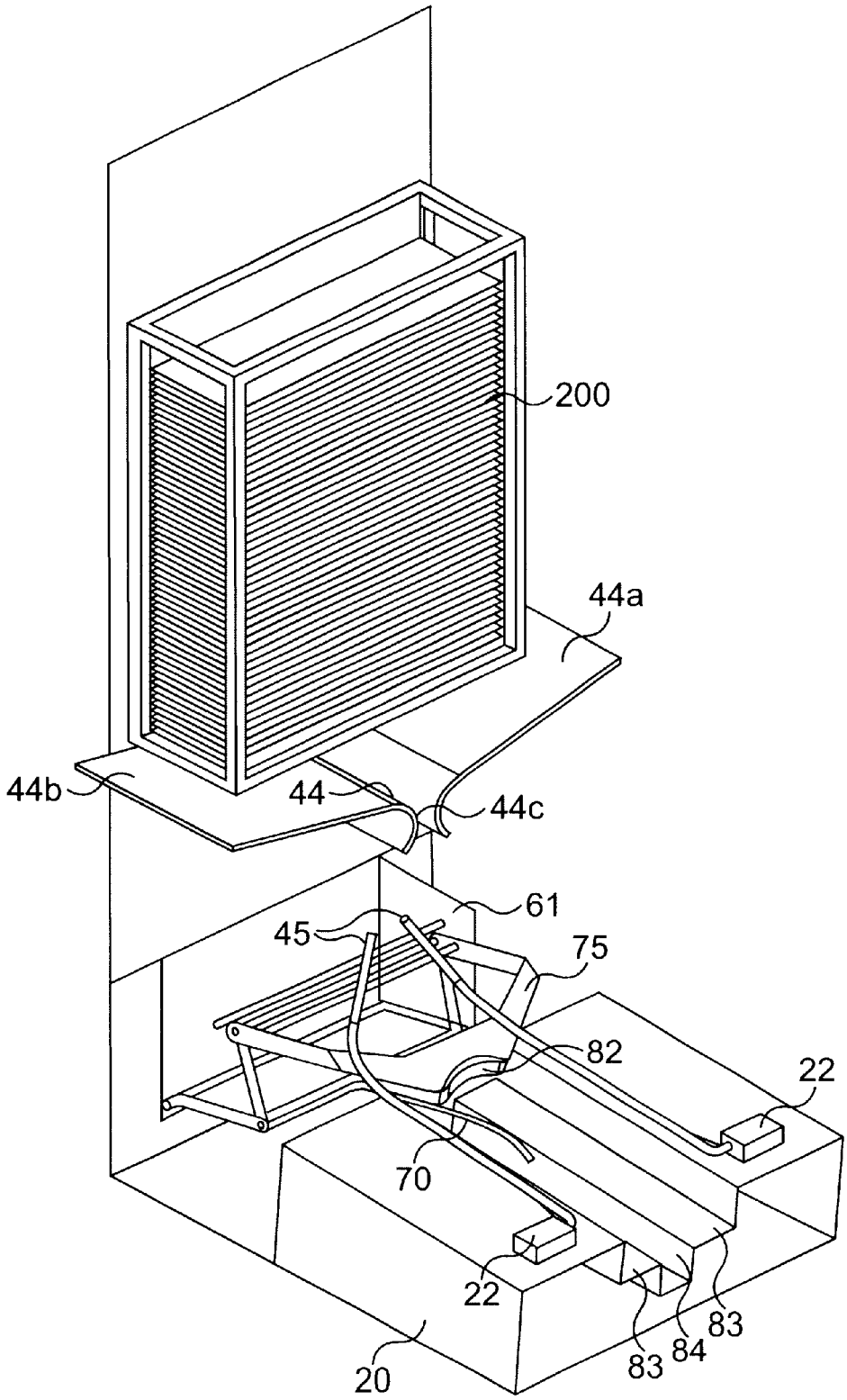
FIG. 4 is a perspective view of another portion of the device according to FIG. 1.

Referring now to FIG. 4. FIG. 4 shows actuator 70, retaining member 75, separation members 85 and how each of these elements cooperates with guide members 45 of the preferred embodiment. In the preferred embodiment of the present invention, the actuator 70 consists of a foot pedal activated when a user's foot depresses the foot pedal. Although actuator 70 is shown as a foot pedal, actuator 70 may be a push button, knob, switch, lever or the like. Additionally, the actuator 70 may be triggered manually, via sensing means (e.g. an optical sensor) or even voice activated. Actuator 70 is employed to release the retaining member 75 and initiate the operation of separation member 85.

In the preferred embodiment illustrated in FIG. 4, both the actuator 70 and guide members 45 extend into the application portion 80 of the device 100. There, the guide members 45 are spaced apart so as to hold the shoe cover 310 open within the application portion 80. The application portion 80 includes a foot tray 81. The guide members 45 preferably run along the longitudinal edges of the foot tray 81 while the actuator 70 extends over the foot tray 81 between the guide members 45.

Figure 7:
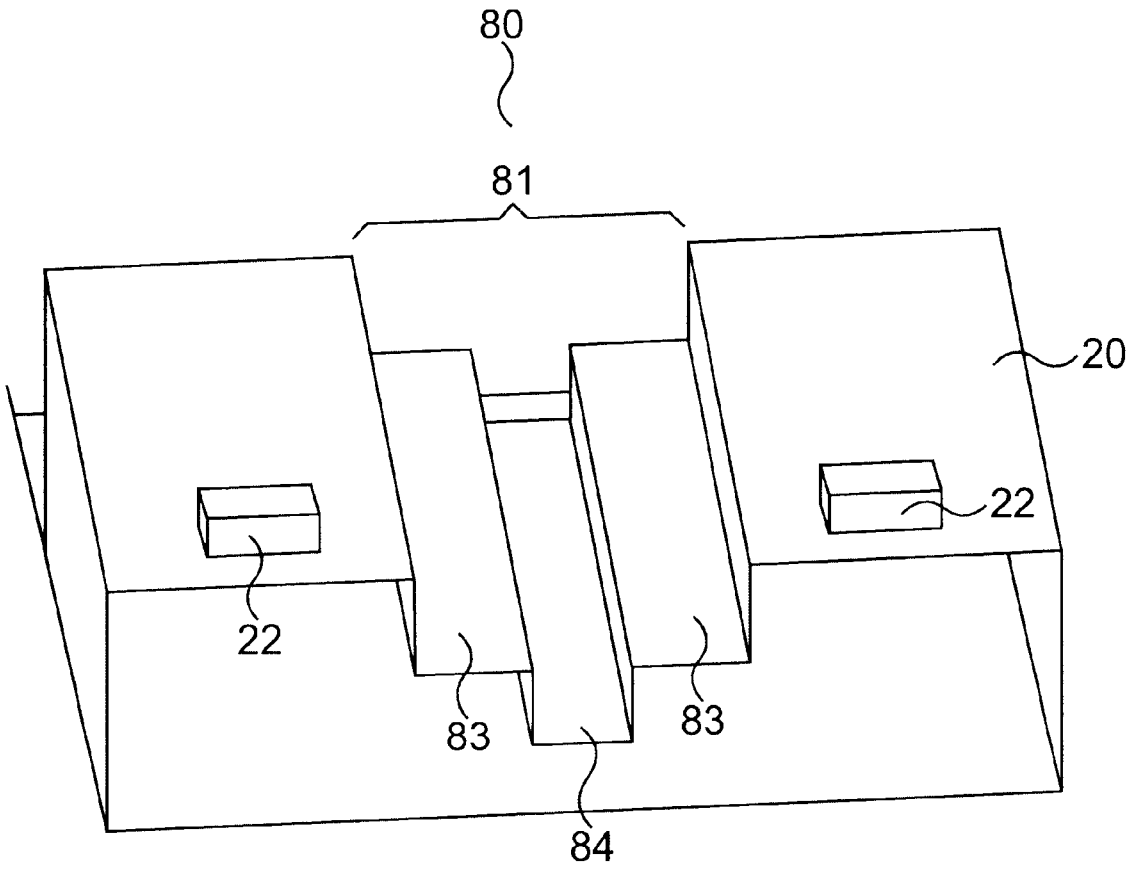
FIG. 7 is a close-up perspective view of the application portion of the present invention.
Figure 8:
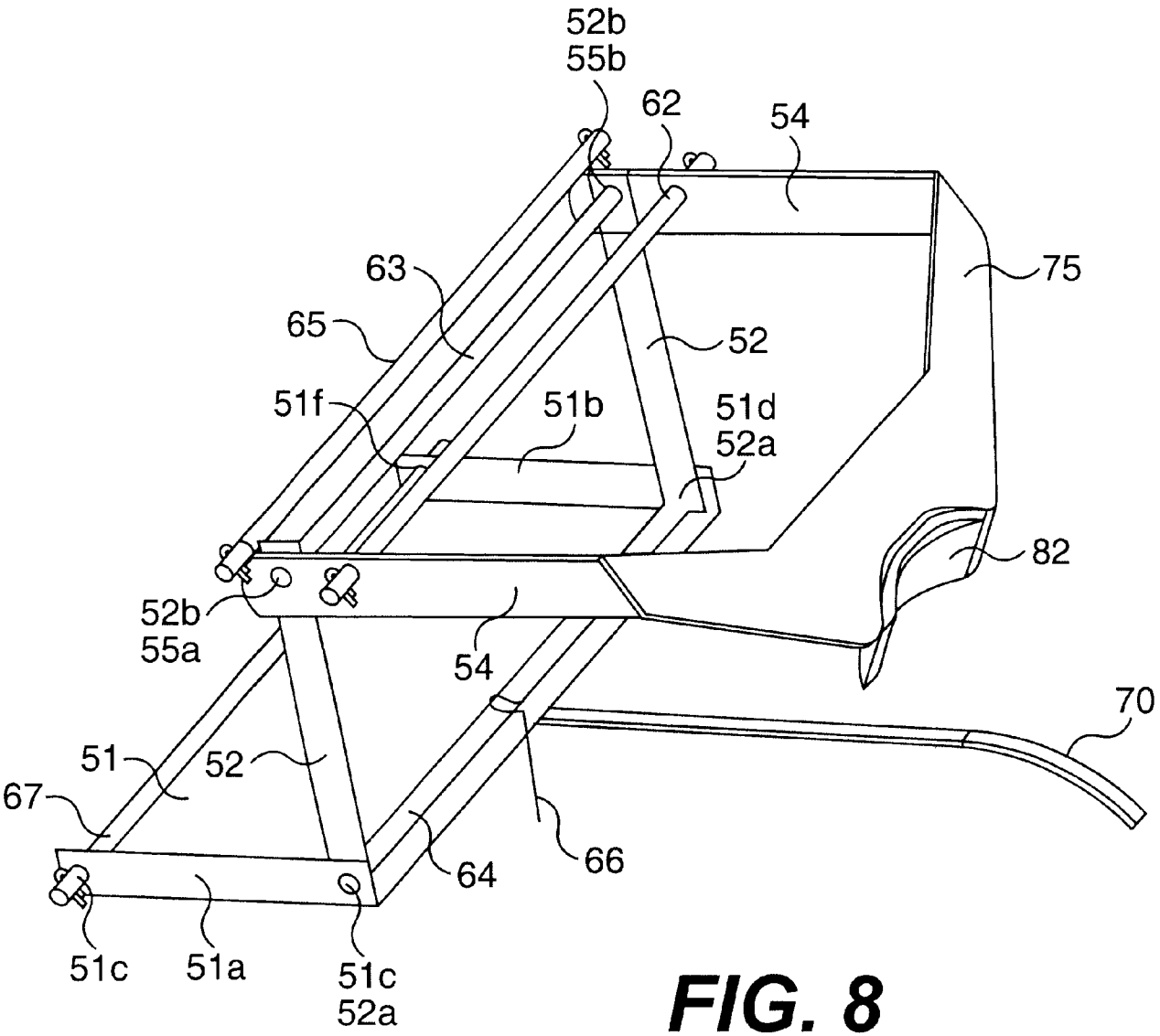
FIG. 8 is a close-up perspective view of the linkage system of the present invention.

The foot tray 81 may be configured to receive shoe types of various shapes and sizes. FIG. 7 shows a close-up of the preferred embodiment of foot tray 81. As can be seen in the Figure, the foot tray 81 may comprise a channel 83 for receiving the sole of a shoe and channel 84 within channel 83 for receiving a high-heel portion of a shoe. Alternatively, the foot tray 81 could include interchangeable platforms of varying configurations to accept a wide assortment of different shoe sole shapes according to the footwear requirements of the environment within which the device 100 is used.

Figure 5:
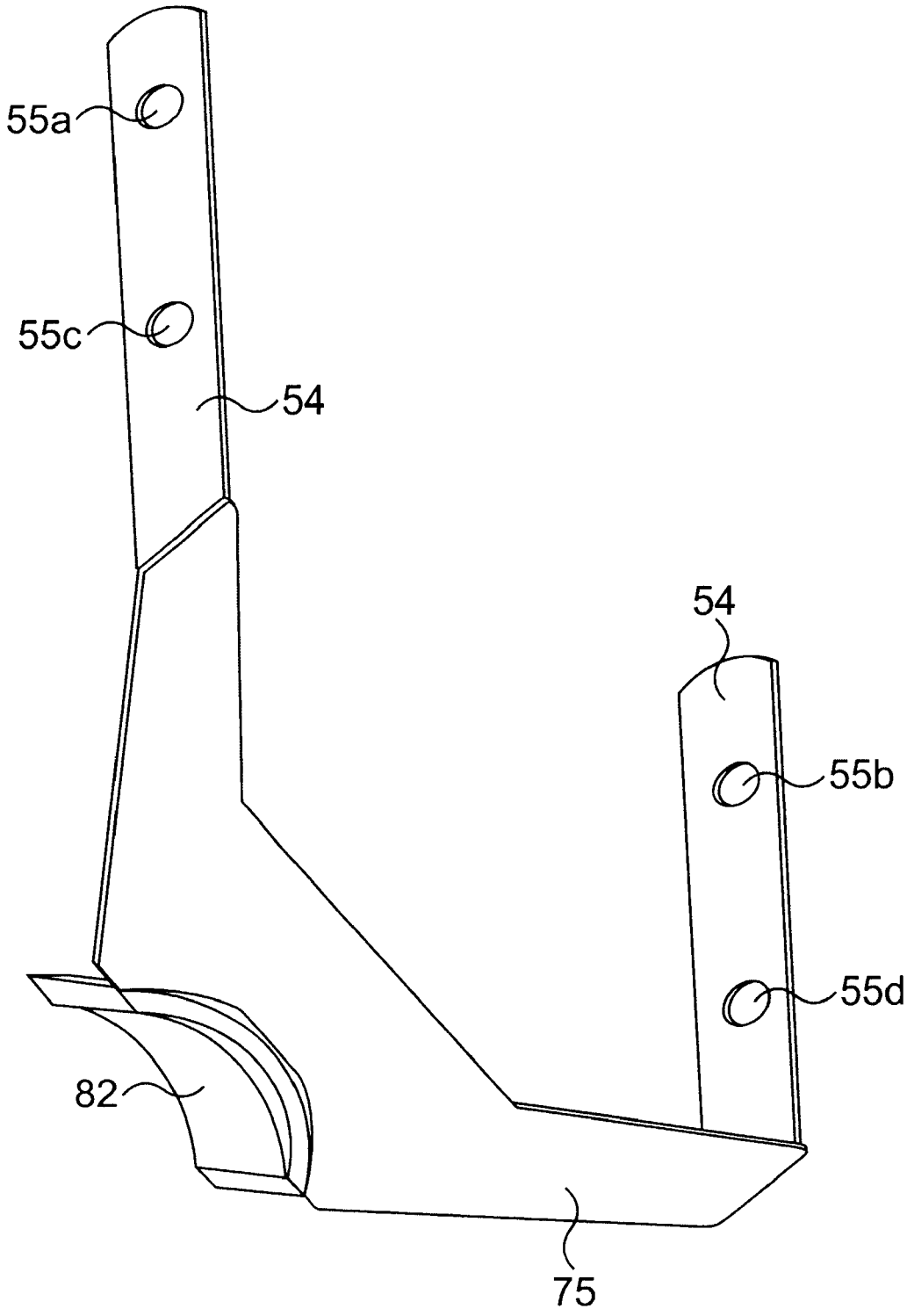
FIG. 5 is a close-up perspective view of the retaining member of present invention.

Additionally, the preferred embodiment, a toe guide 82 is positioned in application portion 80. The toe guide 82 is generally configured to receive the front (toe) portion of the user's shoe. Preferably, the toe guide 82 is coupled to retaining member 75, as shown in FIG. 5.

With the guide members 45 holding the shoe cover 310 open in the receiving position within the application portion 80, the shoe cover 310 overlies both the actuator 70 and the foot tray 81. Thus, upon insertion of a shoe into the receiving shoe cover 310, actuator 70 is depressed (activated) and the shoe rests upon the foot tray 81 substantially surrounded by the receiving shoe cover 310. The activation of the actuator 70 releases the retaining member 75 and initiates the operation of the separation member 85. The release of retaining member 75 along with the activation of separation member 85 permits the withdrawal of the user's foot from the foot tray 81 with the shoe cover 310 substantially surrounding the shoe.

Figure 6:
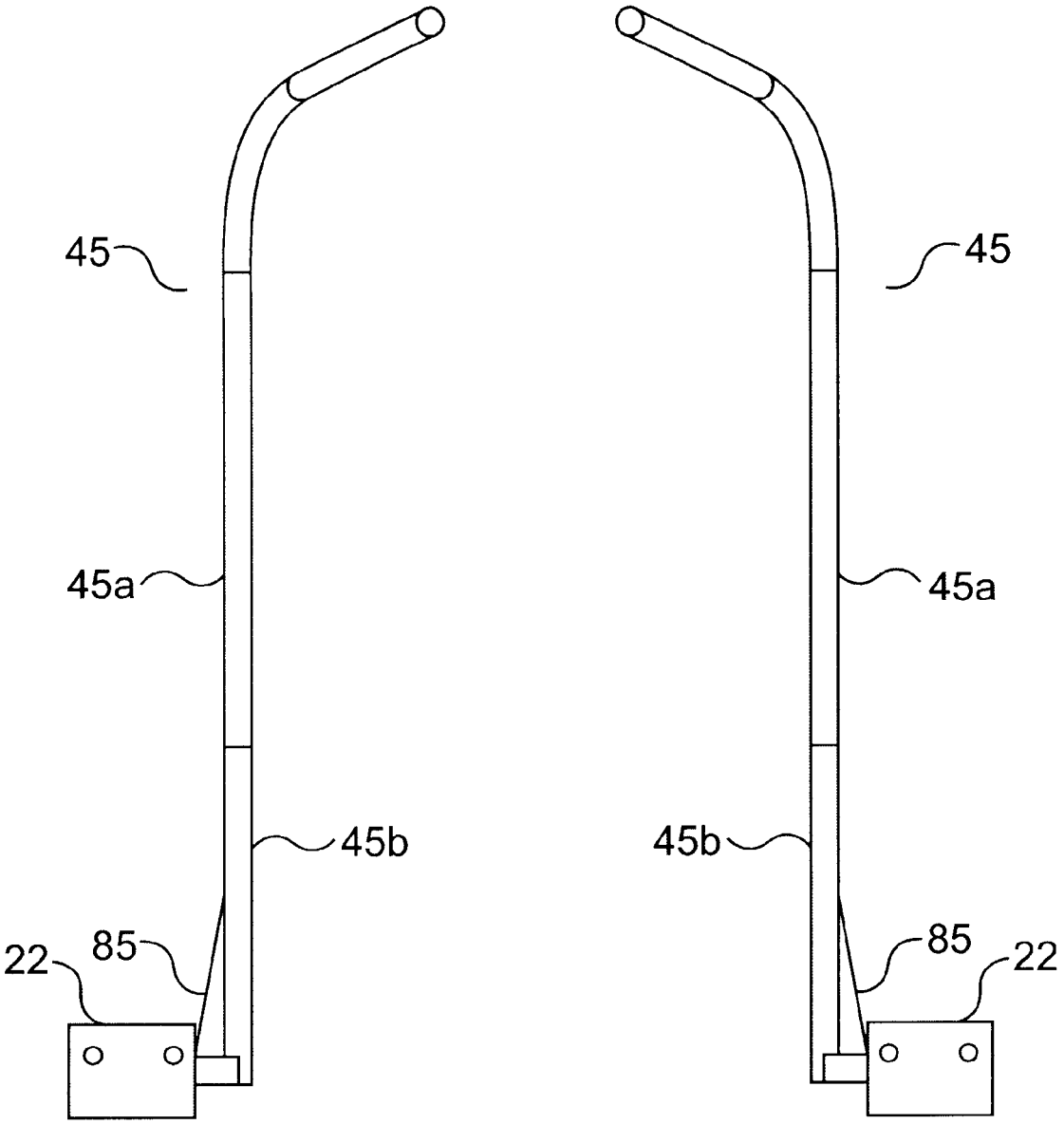
FIG. 6 is a close-up top view of the guide members of the present invention.

In the preferred embodiment, separation member 85 includes of a pair of cutting blades positioned at the mounting portions 45*b* of the guide members 45, as shown in FIG. 6. As the user slides his or her foot off the foot tray 81, the separation member 85 separates the shoe cover 1310 from device 100. Particularly, the cutting blades slice open the tubes 330 of the shoe cover 310 that hold the shoe cover 310 on guide members 45 as the shoe cover 310 passes the cutting blades on the mounting portions 45*b* of guide members 45. Thus, the shoe cover 310 is separated from the device 100 and is free to contract around the wearer's shoe.

Although the preferred embodiment describes the separation member 85 as a pair of cutting blades, it is to be understood that any appropriate means known in the art of separating the shoe cover 310 from the device 100 may be utilized. It should be evident to one skilled in the art that various separating members are available to cooperate with any suitable means known in the art for delivering the shoe covers 310 to the application portion 80, including the guide members 45 of the preferred embodiment.

As mentioned above, actuator 70 operates to release retaining member 75. The preferred linkage system is illustrated in detail in FIG. 9. However, it is to be understood by one skilled in the art that any mechanical or electrical connection may be used to translate the activation of actuator 70 into the release of retaining member 75.

Figure 9:
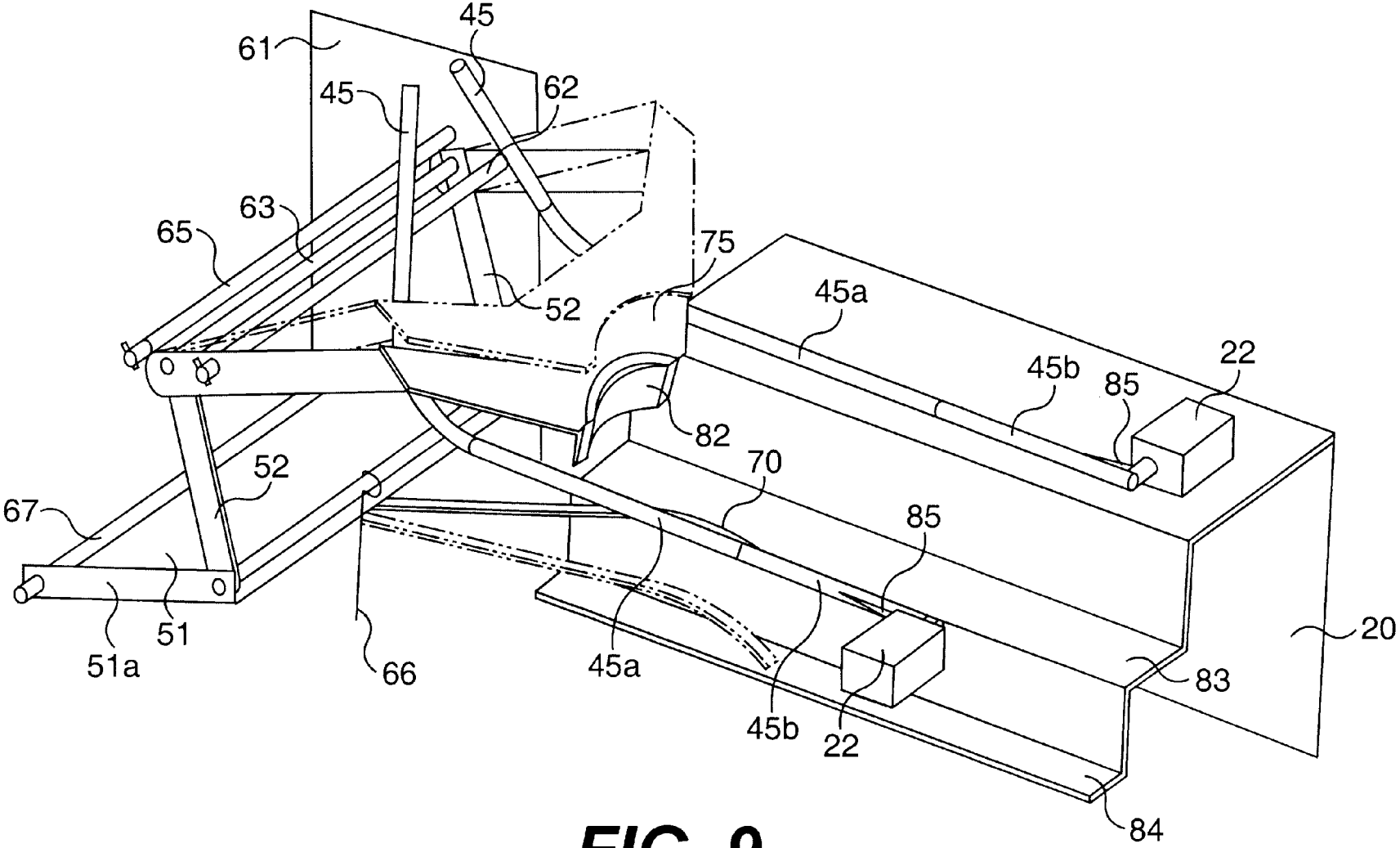
FIG. 9 is an exploded perspective view of a portion of the device according to FIG. 1.

Turning now to preferred embodiment shown in FIG. 9, body 10 houses a linkage system 50 and actuator 70. The linkage system 50 preferably includes a rectangular tray 51 with folded-up edges 51*a* and 51*b*, a pair of intermediate links 52 having apertures 52*a* and 52*b* at each end and a retaining member 75 having a pair of mounting members 54 extending from each end, as shown in FIG. 5. Apertures 51*c*, 51*d*, 51*e* and 51*f* are provided in the folded-up edges 51*a* and 51*b* of rectangular tray 51. Each of the mounting members 54 includes a pair of apertures 55*a*, 55*b*, 55*c*, and 55*d*. The actuator 70 is coupled to the rectangular tray 51, which in turn is coupled to an end of the intermediate link 52. The opposite end of the intermediate link 52 is coupled to retaining member 75.

The preferred linkage system 50 also comprises a U-shaped mounting bracket 61, mounting rods 62 and 67, connecting rods 63 and 64, limiting rod 65 and biasing member 66. Mounting bracket 61 is fixed to the inside of body 10. Mounting rod 62 passes through apertures 55*c* and 55*d* to couple retaining member 75 to mounting bracket 61 so that the retaining member 75 may rotate about mounting rod 62. Mounting rod 67 passes through apertures 51*e* and 51*f* of rectangular tray 51 to couple the rectangular tray 51 to the mounting bracket 61. Thusly, one longitudinal edge of the rectangular tray 51 may rotate about mounting rod 67. Connecting rod 63 passes through apertures 52*b* of each intermediate links 52 and through apertures 55*a* and 55*b* of the mounting members 54 to pivotally couple the intermediate links 52 and the retaining member 75. Thus, intermediate links 52 rotate relative to the retaining member 75. Finally, connecting rod 64 passes through apertures 52*a* of intermediate links 52 and apertures 51*c* and 51*d* in the rectangular tray 51, coupling each of the intermediate links 52 to the folded-up edges 51*a* and 51*b* of the rectangular tray 51.

The actuator 70, may be coupled, or fixed, at one end, to the rectangular tray 51 so that the motion imparted to the actuator 70 is transferred to rectangular tray 51. The other end of actuator 70 extends out of body 10 and is freestanding. The range of motion of both rectangular tray 51 and actuator 70 is limited by biasing member 66 and limiting rod 65. Biasing member 66, shown in FIG. 3, is preferably but not limited to, a spring, and is mounted to both the mounting bracket 61 and the rectangular tray 51. The spring 66 is set to restrain the upward movement of rectangular tray 51. The limiting rod 65 is mounted at each end to mounting bracket 61 above the linkage system 50 to limit the upward movement of linkage system 50 and in turn the upward movement of the actuator 70.

The body 10 and base 20 of the shoe cover application device include a removable exterior casing 90. Casing 90 serves as a protective cover to minimize contamination of the shoe covers 310 within the shoe cover application device 100. Optionally, a retractable cover (not shown) conceals the application portion 80 of the shoe cover application device 100. Such a cover could comprise manually activated or automated sliding or pivoting panels, or a removable cap or casing. With such a cover, the shoe covers 310 are not exposed to contaminants when they are situated in the application portion 80.

The operation of the preferred embodiment will now be described. The continuous type shoe cover 310 is loaded into the shoe cover application device 100 as each fresh package 200 is inserted into bin 30. The package 200 is opened at opening 201 and set into bin 30 so that opening 201 aligns with opening 35 in bin 30. Removable casing 90 is removed and the first continuous disposable shoe cover 310 in the lineal 300 is manually, or by other means, pulled from package 200. The continuous shoe cover lineal 300 is then fed through the neck 45 of funnel guide 44. While retaining member 75 is raised to a non-retaining position, each tube 330 of the shoe cover 310 is then set on the each guide pipe 45 and drawn through the shoe application device 100. The shoe cover 310 is fed along guide pipe 45 until the shoe cover 310 overlays the application portion 80 and actuator 70. The spacing of the guide members 45 at holding portions 45*a* hold open the shoe cover 310 against the bias of the elastic member 370 so that the user may place his or her foot inside it. Although the guide members 45 are illustrated at a particular spacing, it is to be understood by one skilled in the art that the spacing of the guide members 45 may be adjusted, or adjustable, to accommodate shoes of various widths. Once the shoe cover 310 is in position to be applied to a shoe within the application portion 80, the retaining member 75 is released and allowed to return to its natural retaining position; precluding the shoe cover lineal 300 from advancing through the shoe application device 100. The casing 90 may then be reattached to the shoe application device 100.

Alternatively, the shoe covers 310 may be automatically drawn out of the package 200 using vacuum power or other means known in the art and positioned on guiding system 40 to be fed through the device 100. Moreover, shoe covers 310 within package 200 may alternatively be interlocked so that as one is removed from the package 200 and positioned on guiding system 40, the next shoe cover 310 is drawn out of the package 200 ready for placement upon the guiding system 40.

Once the user is ready to wear the shoe cover 310, he actuates the freestanding end of the actuator 70. Preferably, the user steps on a pedal located below the receiving shoe cover 310 within the application portion 80; depressing the pedal or freestanding end of the actuator 70 into channel 83 so that the user's foot is within the receiving shoe cover 310. The pressing of the pedal causes the front longitudinal edge of the rectangular tray 51 to move downward as the rear longitudinal edge of the rectangular tray 51 rotates about mounting rod 67. Connecting rod 64 does not permit intermediate links 52 from rotating relative to rectangular tray 51. Thus, the downward motion of rectangular tray 51 is transmitted to intermediate links 52. As the intermediate links 52 move downward, retaining member 75 pivots about the longitudinal axis mounting rod 62 since mounting rod 62 is fixed to mounting bracket 61. However, connecting rod 63 is not fixed to the mounting bracket 61. Therefore, as retaining member 75 pivots about the longitudinal axis of mounting rod 62, mounting members 54 of the retaining member 75 rotate relative to intermediate links 52. Through this rotation, retaining member 75 is moved to a non-retaining position as actuator 70 is depressed.

At this point, the user's foot is in the receiving shoe cover 310 and the retaining member 75 is in a non-retaining position. As long as the retaining member 75 is in a non-retaining position, the continuous shoe cover lineal 300 is free to advance along the guide members 45. The user then pulls his or her foot, enclosed by the shoe cover 310, off of the foot tray 81 allowing the elastic member 370 to contract and substantially enclose the user's shoe. Upon the user's action, the actuator 70 is released which, through linkage system 50 and mounting system 60, causes the retaining member 75 to rotate to a retaining position. As the user pulls his or her shoe off of foot tray 81 with the shoe cover 310 on the shoe, separation member 85 cut away the tubes 330 of the receiving shoe cover 310 from the holding portions 45*a* of the guide members 45. Simultaneously, the receiving shoe cover 310 is torn away from the shoe cover lineal 300 at the perforation 380; leaving the subsequent shoe cover 310 in a receiving position upon the holding portions 45*a* of the guide members 45.

As an alternative to guide members 45, the shoe cover 310 could be held in place as it is conveyed through the shoe application device 100 by a clamping device. A clamp releasing mechanism or the like positioned at application portion 80 would be used instead of separation member 85 operating in conjunction with retaining member 75 as a separating system.

The preferred embodiment has been described above. However, it is to be understood that various modifications and additional features are available to one of ordinary skill in the art. For example, although a mechanically driven shoe cover applicator device has been described in detail, the continuous shoe cover lineal could be loaded, fed and driven through the device using any apt mechanical or electronic means including vacuum or hydraulic power. The device may coin operated, actuated via a push-button, hand lever, infrared sensors or any other suitable means of actuation. Additionally, handrails may be provided to help the user maintain his or her balance as they use the device.

It should also be understood that various changes and substitutes and alterations could be made to the invention without departing from the spirit and the scope of the invention as defined in the following claims.

I claim:

1. A shoe cover application device for applying a shoe cover to a shoe comprising:

a holding member, said holding member configured to hold a first shoe cover in a receiving position;

a separation member;

a retaining member having a retaining position and a non-retaining position; and an actuator selectively controlling the movement of said retaining member from the retaining position to the non-retaining position;

wherein when said retaining member is in the non-retaining position said separation member is operable to separate the shoe cover from said holding member.

2. The shoe cover application device of claim 1 further comprising:

a storage bin; and a guiding system, said guiding system guiding the first shoe cover to said holding member from said bin.

3. The shoe cover application device of claim 2, wherein said actuator is coupled to said retaining member such that the activation of said actuator releases said retaining member from the retaining position.

4. The shoe cover application device of claim 2 wherein said guiding system is coupled to said holding member to guide a second shoe cover to said holding member once the first shoe cover has been separated from said holding member.

5. The shoe cover application device of claim 4, wherein said retaining member is disposed to prevent said guiding system from guiding a shoe cover to said holding member when said retaining member is the retaining position.

6. The shoe cover application device of claim 1 wherein said actuator is activated by the insertion of a shoe into the first shoe cover.

7. The shoe cover application device of claim 6 wherein said actuator comprises a foot pedal disposed below the first shoe cover.

8. The shoe cover application device of claim 1, wherein said separation member comprises a cutting member for cutting said first shoe cover away from said holding member.

9. The shoe cover application device of claim 1, wherein said separation member is positioned such that upon removal of a shoe inserted into the first shoe cover, while the shoe is at least partially surrounded by the first shoe cover, said separation member separates the first shoe cover from said holding member allowing the first shoe cover to constrict around the shoe.

10. The shoe cover application device of claim 1, further comprising:

a storage bin; and a guiding system, said guiding system guiding the shoe cover to said holding member from said bin;

wherein the activation of said actuator releases said retaining member from said retaining position thereby allowing the removal of a shoe inserted into the first shoe cover, with the shoe at least partially surrounded by the first shoe cover.

11. The shoe cover application device of claim 2, wherein the first shoe cover is one end of a continuous lineal of shoe covers.

12. The shoe cover application device of claim 11 wherein said retaining member is disposed to prevent said guiding system from guiding the first shoe cover to said holding member and to prevent the separation of the first shoe cover from the lineal of continuous shoe covers while said retaining member is in the retaining position.

13. The shoe cover application device of claim 12, wherein said actuator is coupled to said retaining member such that the activation of said actuator releases said retaining member from the retaining position.

14. The shoe cover application device of claim 12 wherein said actuator is coupled to said retaining member such that the activation of said actuator release said retaining member from the retaining position, thereby allowing the first shoe cover to be separated from said holding member by said separation member and separated from the lineal of continuous shoe covers.

15. The shoe cover application device of claim 14 wherein said guiding system is coupled to said holding member to guide a second shoe cover in the lineal of continuous shoe covers to said holding member once the first shoe cover is separated from said holding member and the lineal of continuous shoe covers.

* * * * *